US005725460A

United States Patent [19]

Marsh

[11] Patent Number: 5,725,460

[45] Date of Patent: Mar. 10, 1998

[54] ADJUSTABLE WEIGHT LIFTER'S BENCH

[76] Inventor: John P. Marsh, 3820 E. Briarwood Terrace, Phoenix, Ariz. 85044

[21] Appl. No.: 683,582

[22] Filed: Jul. 15, 1996

[51] Int. Cl.[6] ..... A63B 21/078

[52] U.S. Cl. ..... 482/104

[58] Field of Search ..... 482/94, 104, 142, 482/308; 297/316, 320, 363, 364, 378.12

[56] References Cited

U.S. PATENT DOCUMENTS

| | | | |
|---|---|---|---|
| 3,138,400 | 6/1964 | Reid | 297/363 |
| 4,653,751 | 3/1987 | Green | 482/104 |
| 4,666,150 | 5/1987 | Segrist et al. | 482/104 |
| 4,729,561 | 3/1988 | Desjardins | 482/104 |
| 4,773,642 | 9/1988 | Cruz | 482/104 |
| 5,411,959 | 5/1995 | Hayden | 482/104 |
| 5,472,397 | 12/1995 | Ammoscato et al. | 482/104 |
| 5,616,108 | 4/1997 | Hayden | 482/104 |

*Primary Examiner*—Richard J. Apley
*Assistant Examiner*—John Mulcahy
*Attorney, Agent, or Firm*—Gregory J. Nelson

[57] ABSTRACT

A bench-type weight support having racks at opposite sides of a bench. The racks support adjustable saddles which receive weights such as dumbbells. The saddles are angularly disposed to provide the proper alignment when grasped by a user from a supine position. In the preferred embodiment, the bench has a seat and a back which are independently adjustable to provide a wide range of exercising positions.

13 Claims, 4 Drawing Sheets

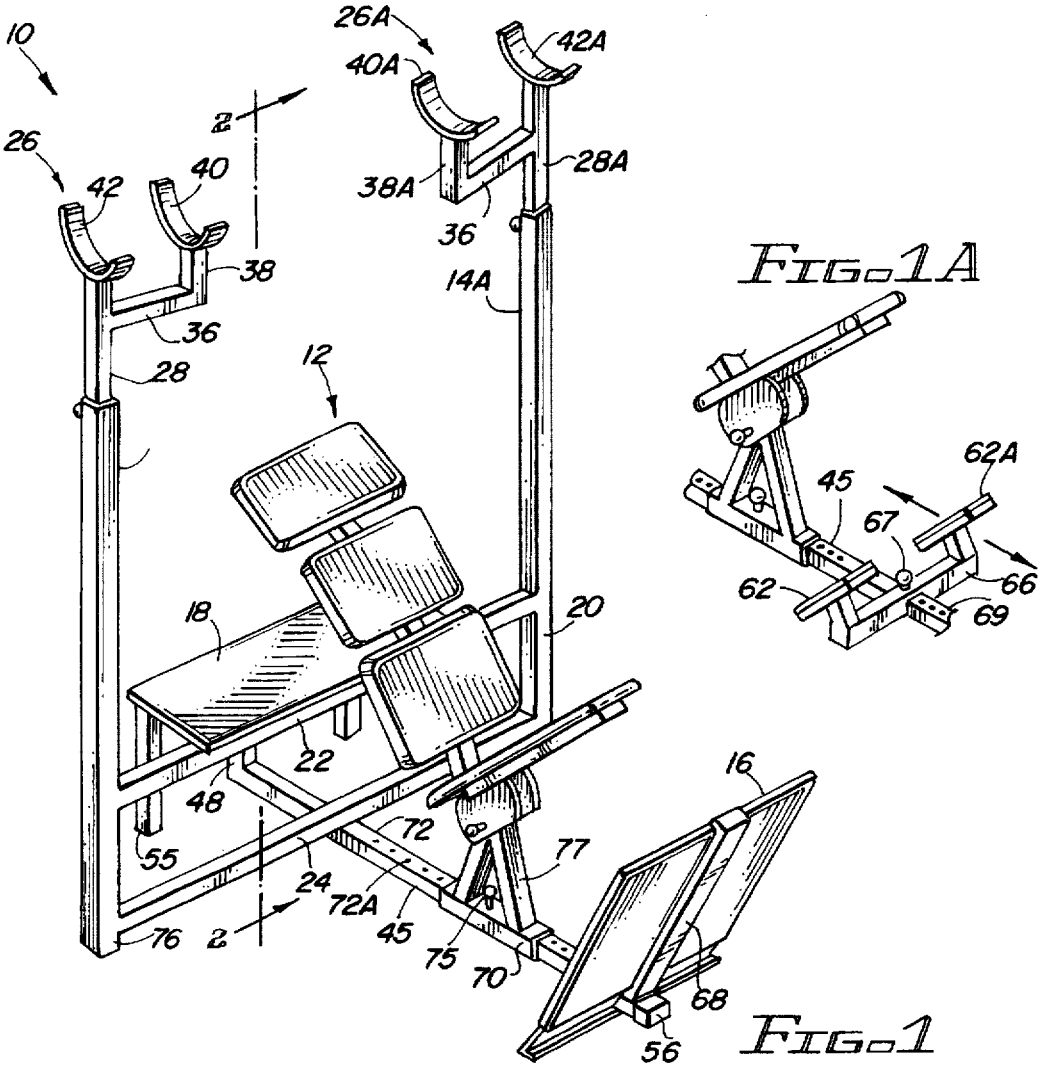
FIG. 1A
FIG. 1
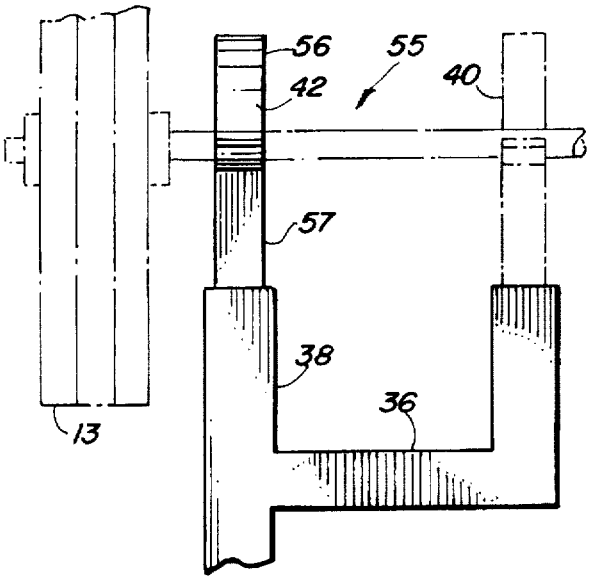
FIG. 3A

ADJUSTABLE WEIGHT LIFTER'S BENCH

BACKGROUND OF THE INVENTION

FIELD OF THE INVENTION

The present invention relates to athletic equipment and more particularly relates to a bench-type apparatus for supporting a weight lifter which bench has an integral weight rack for supporting weights such as dumbbells when exercising.

Weight lifters, using free weights, often perform various weight lifting exercises while supported on a bench in a horizontal, inclined or sitting position. Benches of this type are generally nonadjustable and are used in conjunction with racks which support the weights at either side of the bench. It is more convenient and safer for the exerciser to begin exercising routines with the weights elevated which allows the individual to assume the proper position and begin exercising. Typical of weights used in this manner are heavy dumbbells which, because of their weight, often require the assistance of spotters. Spotters are training partners who assist the individual performing the exercise by positioning the weights in the beginning position and assisting the exerciser in returning the weights to the weight racks or supports when the exercise is completed.

Several patents may be found in the prior art which are representative of bench-type devices for use by weight lifters.

U.S. Pat. No. 4,205,838 shows adjustable safety stands for supporting the plates of a bar bell in an elevated position on either side of an exercising bench. The safety stands have receiving members on their upper ends. While the design of this patent is useful, it has certain disadvantages, as for example, the supports are independent of the bench and may therefore easily become unstable and tip or may become improperly positioned for convenient access of the weights by the weight lifter.

U.S. Pat. No. 4,666,150 shows a saddle mountable on telescoping tubular members or permanent tubular members that will support a dumbbell. An open space is provided in the saddle to allow the exerciser to pass through on the return of the dumbbell to the saddle. While this device is somewhat similar to that shown in the '838 patent, and also provides certain advantages to exercisers, it also has the disadvantage that the saddles or weight supports are independent from the bench and, therefore, may easily tip or become unstable during an exercise routine.

U.S. Pat. No. 4,412,678 shows a saddle for the bar of a bar-type weight having a bar-receiving portion on a socket at the upper end of a rod-like support. The design eliminates welds between the bar-receiving portion of the arms and the socket-forming portion to better withstand static and dynamic forces. The saddle is shown as an integral part of the bench but the device of the '678 patent is not intended for use with dumbbell-type weights, but rather is intended for use with bar-type weights.

From the foregoing, it will be seen there are various bench and rack devices for assisting a weight lifter or power lifter. However, there nevertheless exists a need for an improved device which will be relatively easy to manufacture, highly adjustable to accommodate various exercise and exercise positions, particularly when using dumbbells.

BRIEF SUMMARY OF THE INVENTION

Accordingly, the present invention broadly relates to a bench having integral weight supports which bench is for use by body builders, power builders and athletes when working out with dumbbells or other types of weights.

Briefly the present invention relates to a bench-type device having a bench for supporting the body of the weight lifter and has integrally attached racks for the support of free weights above the user when the user is seated or lying on the bench. Each rack has a pair of U-shaped saddles which are vertically adjustable. The saddles are angularly disposed to provide the user proper arm and wrist alignment when grasping the weights. The device has a foot rest and a platform for a spotter is located at the rear of the device.

In the preferred embodiment, the bench has both a backrest and a seat portion which are independently adjustable between a generally horizontal position and a sitting position. In other embodiments, the bench may be fixed in a generally horizontal or an inclined position.

It is an object of the invention to provide a unique weight lifting bench device which can be inexpensively manufactured using conventional materials and which provides the weight lifter both safety and versatility.

A broad object of the present invention is to provide a weight lifter's bench, which bench has a seat and back support which can be variously adjusted to multiple positions for the convenience and safety of the weight lifter permitting a wide range of exercises.

Another object of the present invention is to provide a weight lifting apparatus which allows the weight lifter ergonomically proper and unrestricted access to the weights and movement during performance of exercises.

Another object of the present invention is to provide a weight lifting apparatus which provides a location for positioning a spotter to assist the weight lifter.

Another object of the present invention is to provide a weight lifting apparatus in which the bench and the weight supports are integrally formed for stability and safety.

BRIEF DESCRIPTION OF THE DRAWINGS

The above and other objects and advantages of the present invention will become more readily apparent from the following description, claims and drawings in which:

FIG. 1 is a perspective view of the preferred embodiment of the weight lifter's bench of the present invention;

FIG. 1A is a perspective view of the foot end of the bench frame;

FIG. 3A is a front view of the upper end of an alternate rack for use with the bench;

DETAILED DESCRIPTION OF THE DRAWINGS

Figure 3:
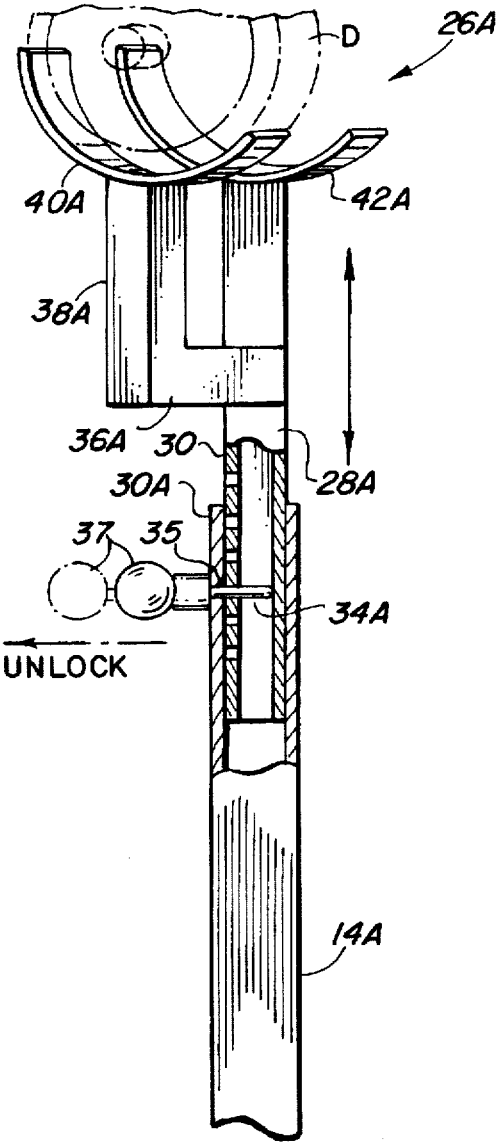
FIG. 3 is a side view of the upper end of the weight-supporting rack as indicated in FIG. 2.
Figure 2:
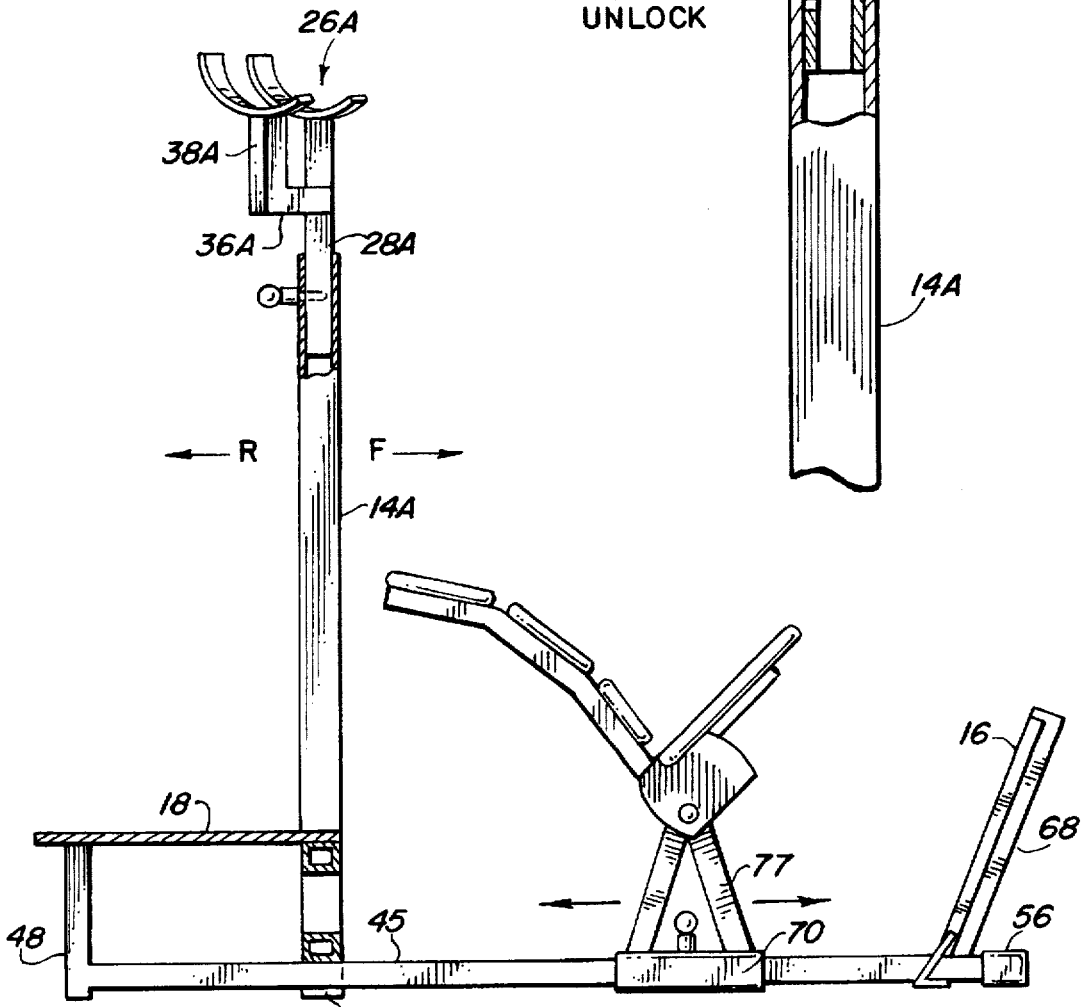
FIG. 2 is a side elevational view thereof.

Turning now to the drawings, a preferred embodiment of the weight lifting apparatus of the present invention is shown in FIGS. 1 to 7 and is generally designated by the numeral 10 and including a bench 12, weight supports 14, 14A, foot rest 16 and platform 18 on which a spotter or assistant may stand to assist the weight lifter.

The bench assembly 10 consists of a frame 20 suitably fabricated from suitably sturdy structural components such as tubular steel. The frame includes spaced-apart vertical support members 14 and 14A which define an exercising area 25 therebetween and typically would be spaced apart about three feet. The lower ends of the vertical support members 14, 14A are interconnected by cross members 22 and 24 as by welding or other convenient fabricating techniques. The support members 14, 14A are shown as generally square tubular steel sections. Weight racks 26 and 26A are adjustably received in the upper end of the support members 14, 14A. The racks are similar in construction, although one is intended to be positioned on the right hand support 14 and the other is constructed for a position in the left hand support 14A. A description of rack 26A will be understood to also apply to rack 26. As best seen in FIG. 3, the rack 26A has a vertical tube member 28A which is slidably received within the upper end of member 14A. The tube member 28A has a cross sectional configuration conforming to the cross sectional configuration of the longitudinal opening within member 14A, in this case being square. The rear surface of member 28A is provided with a plurality of vertically aligned apertures 30, 30A, etc. The upper end of support 14A carries a detent pin 34A. The detent pin 34A extends horizontally through an opening 35 in the rear face of support 14A. It will thus be seen that the position of the rack can be vertically adjusted by manually removing detent pin 34A and inserting the detent pin in one of the selected holes 30, 30A, etc. in registry with pin. The detent may be biased to the locked position by a spring as is well known. The other end of the detent pin carries a knob 37 for convenience of use.

Figure 7:
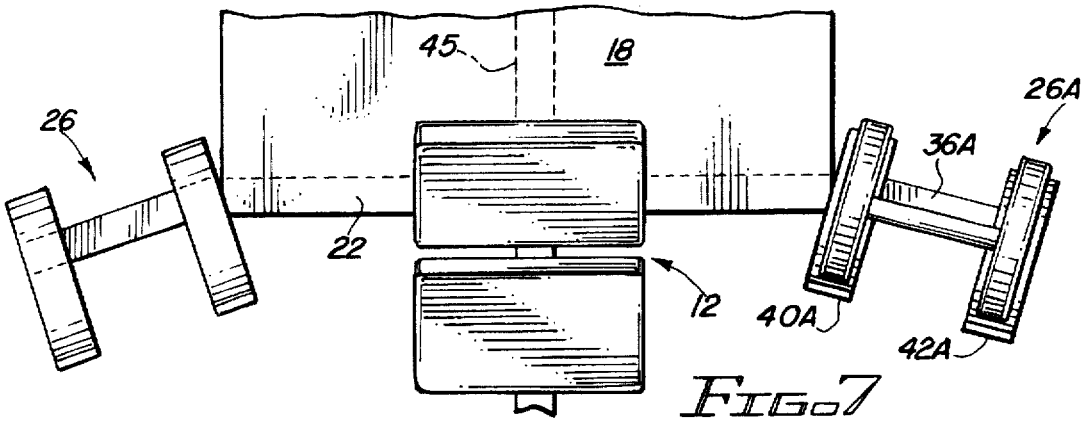
FIG. 7 is a top view of a portion of the apparatus illustrating the ergonomically proper positioning of the weight rack.

The rack is fabricated in the general shape of an inverted "chair" having a horizontally extending leg 36A and an upwardly extending arm 38A parallel to member 28A. Leg 36A is secured to tube member 28A at an angle of approximately 15° with respect to transverse frame member 22, as best seen in FIGS. 3 and 7. This places the supported dumbbells "D" in an ergonomically proper position to be easily grasped by a weight lifter positioned on the bench 12 and extending his or her arms upwardly as the normal orientation of the wrists will be turned slightly inwardly. The members 36 and 36A are also shown as being generally rearwardly curved to provide the user additional clearance when grasping the weights "D". The ends of members 36, 36A terminate at upwardly extending arms 38, 38A which are parallel to members 28, 28A.

The upper end of both arms 28A and 38A carry generally U-shaped saddles 40A, 42A, respectively. It will thus be seen that a conventional dumbbell, "D" as seen in FIGS. 3 and 7, can be placed with the plates of the dumbbell resting on the saddles 40A, 42A, as seen in FIG. 3. Easy access to the bar is accommodated through the open area beneath the saddles and above the cross member 36. The provision of two spaced-apart weight supporting saddles on each side of the bench provides stability and safety. The angular disposition of the saddles operate to position the dumbbell "D" with the axis of its bar at an angle of about 10° to 20° with respect to transverse cross-member 22. The weights are oriented on the supports so their bars may be grasped with the weight lifter's wrists in a natural position making the supports more ergonomically correct. The curved shape of the members 36, 36A provide additional clearance for the hands of the user.

In use, the upper body of the user assumes a supine position in the exercising area 25 defined between the vertical upright support members 14 and 14A. The user-exerciser generally positions himself/herself on the bench 12, which in this embodiment is adjustable to a number of positions to accommodate both the physical size of the user and the requirements of the particular exercise. To this end, the assembly of the present invention includes a generally longitudinally extending track member 45 which is centrally located and extends forwardly of the supports. As used herein, the term "forward" refers to the direction indicated by the arrow "F" in FIG. 2 and rearwardly refers to the direction indicated by the arrow "R" in FIG. 2. The track 45 extends rearwardly of the supports 14, 14A approximately 18" or so, and terminates at a rear end to which it is secured by welding or other conventional fabrication techniques to upwardly extending member 48. A platform 18, which is generally horizontal, is supported between the cross member 22 and upwardly extending member 58. The platform 18 provides an area on which an assistant or spotter may stand or sit positioned above the head of the user and have convenient access to the exercise area 25. Additional legs 55 may be provided adjacent the edge of the platform 18 to provide further support. The spotter platform is optional and may be omitted depending upon the personal preference of the user or trainer.

The track 45 extends forwardly of the supports 14, 14A a distance of 3' to 5'. The terminal end 56 of the support supports a foot plate 16 which is disposed at an angle of approximately 120° with respect to the axis of the track. The foot plate may be longitudinally adjustable but is shown secured to the track by a bar 68 welded to the track. Both the platform 60 and the foot plate 66 are fabricated from a suitable material such as ¼" steel plate.

In FIG. 1A, the foot plate has been replaced with a pair of individual foot pads 62, 62A which are longitudinally adjustable along track 45 at carrier 66 and securable at a selected aperture 72, 72A by detent 67.

The bench 12, as indicated above, is adjustable both to accommodate the physical size of the user and the requirements of the particular exercise being performed. A sitting position is generally preferred when working shoulder muscles while a supine position is generally assumed for exercising the chest. The bench is best seen in FIGS. 1, 2 and 4 through 6 and is longitudinally adjustable along the track 45 by means of a carrier 70 which is shown as a tubular member slidable on the track. The track has a plurality of apertures 72, 72A, etc. in its upper surface and the carrier includes a detent pin 75 which may be withdrawn and selectively registered in one of the apertures to position the carrier and the supported bench in the desired longitudinal location. It is noted that the track 45 is supported above the floor or other supporting surface by pads 76 which allow the carrier to slide without interference with the supporting surface.

The bench is supported by a pedestal 77 extending from the carrier. The pedestal is shown forming an inverted "V" and which, as best seen in FIG. 6, define a pair of spaced-apart side plates 80, 82 at its upper end.

Figure 4:
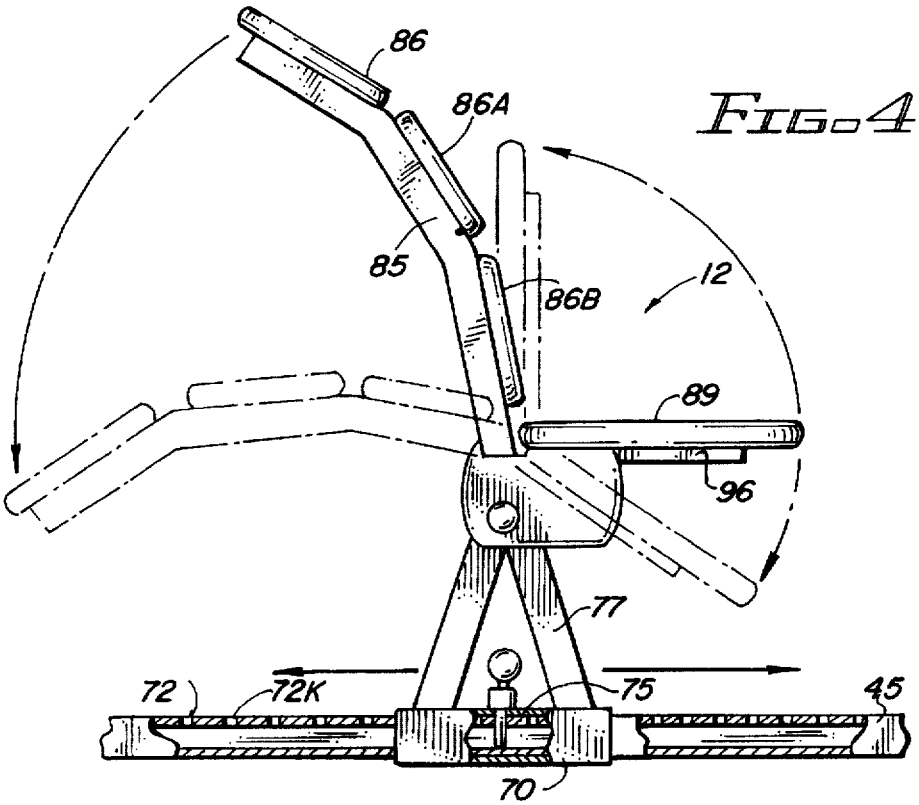
FIG. 4 is a side elevational detail view, partly broken away, showing the range of adjustability of the bench.

The backrest portion of the bench has backrest frame member 85 which, as best seen in FIG. 4, may be fabricated so that it is slightly curved or arcuate. The front or upper surface of the backrest frame is provided with a plurality of pads 86, 86A, 86B for the convenience and comfort of the user.

Figure 5A:
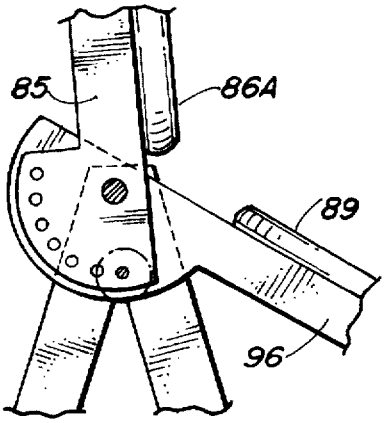
FIG. 5A is a detail view of a portion of the bench showing the seat in its lower-most position and the backrest in its upright position.
Figure 5B:
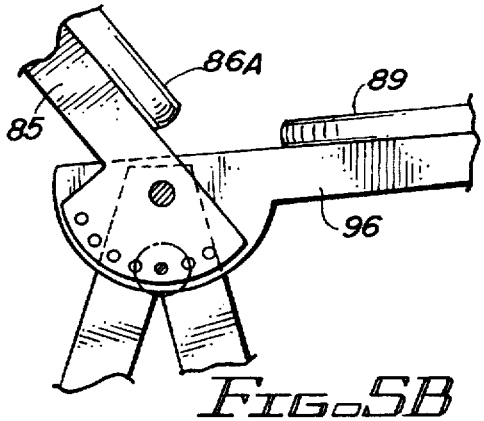
FIG. 5B is a view similar to FIG. 5A with the seat in a horizontal position and the backrest rearwardly tilted.
Figure 5C:
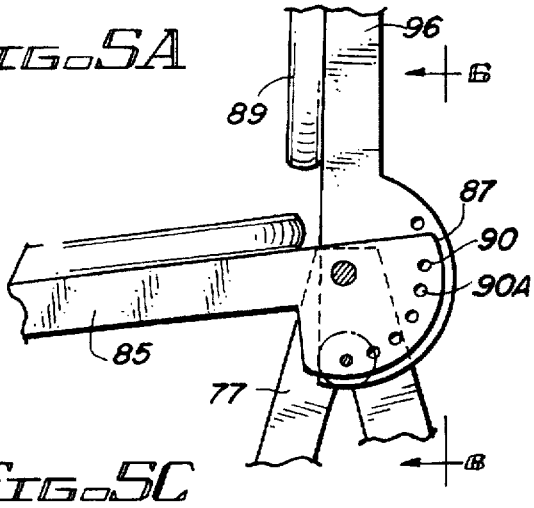
FIG. 5C is a view similar to FIG. 5A with the backrest fully reclined to a generally horizontal position and the seat in a generally vertical position.
Figure 6:
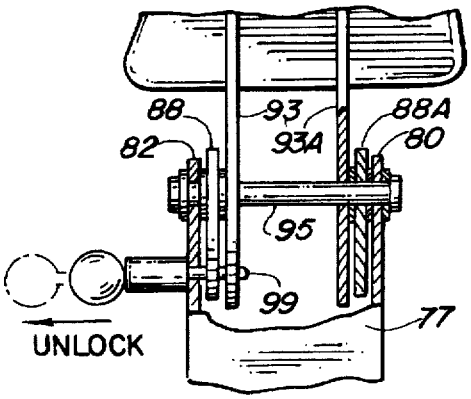
FIG. 6 is a sectional view taken along line 6—6 of FIG. 5C illustrating the seat adjusting mechanism.

The lower end of the backrest frame member 85 terminates at plates 88 and 88A, as best seen in FIGS. 5B and 6. The plate 88 has an arcuate outer surface 89 and defines a plurality of holes 90, 90A, etc. arcuately arranged. The plates 88, 88A are pivotally secured to the upper end of the pedestal about axle 95 which is supported at the upper end of pedestal 77.

The seat portion of the bench has a support member 96, the upper surface of which carries a padded cushion member 89 for the comfort of the user. The rear end of the seat frame member 96 terminates at a pair of spaced-apart, generally semi-spherical plates 93, 93A which are also pivotal about axle 95. As best seen in FIG. 6, the spacing of the components and the adjustment assembly is such that the side plates of the pedestal are outer-most with the backrest plates 93, 93A being positioned inwardly of plates 80, 82 on axle 95. Seat plates 88, 88A are interposed between the support side plates and the adjustment plates on the backrest. Plates 93, 93A are also provided with a plurality of arcuately arranged holes or bores 94 which are selectively registerable with bores 90, 90A, etc. in the backrest assembly.

A detent pin 99, which preferably is spring biased to the position shown in FIG. 6 in known manner, may be manually retracted to the position shown in dotted lines in FIG. 6. In this position, both the seat and backrest may be rotatively adjusted with the seat being adjustable from a vertical position shown in dotted in FIG. 4 to the declining position shown at the other extreme of adjustment in FIG. 4. Similarly, the backrest may be adjusted from the position shown in solid line in FIG. 4 to the generally horizontal position shown in dotted in FIG. 4. Accordingly, the exerciser is provided a wide range of adjustment in accordance with the requirement of the user and facilitates a wide range of motion and a variety of exercises.

It will be noted that either the backrest or the seat may be adjusted independently and both need not be adjusted. To adjust only the seat, the detent pin 99 is released to the position shown in FIG. 6 and the seat adjusted while allowing the backrest to remain in the same position. The detent may then be returned to the position locking the seat in the desired position. The same operation may be performed with respect to the backrest while leaving the seat in the desired position.

Referring to FIG. 3A, a single saddle rack 55 may be utilized in lieu of the dumbbell supports 26, 26A. The rack 55 has an arcuate member 56 supported on a tubular member 57 which is receivable in the upper end of member 14, 14A. This rack is for use with barbells 13 as shown in FIG. 3A.

Figure 8:
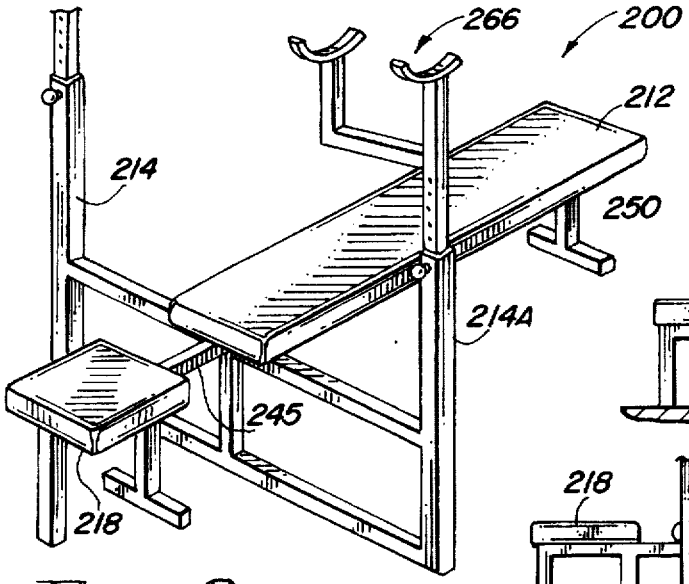
FIG. 8 is a perspective view of an alternate embodiment of the present invention in which the seat is nonadjustable being permanently fixed in a generally horizontal position.
Figure 9:
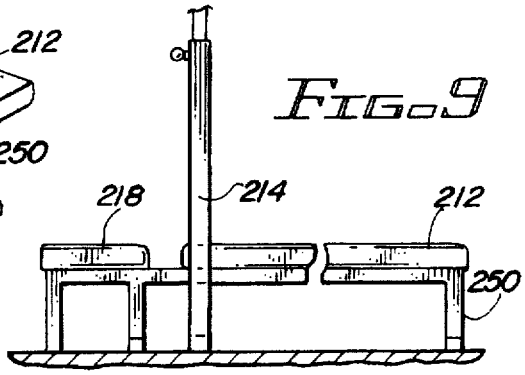
FIG. 9 is a side elevational view of the bench shown in FIG. 8.

FIGS. 8 and 9 show an alternate embodiment of the present invention which is generally similar to embodiment 100. This embodiment is generally designated 200 and again has the vertical supports 214, 214A which support weight-supporting racks 226 at their upper end. The frame includes a padded platform 218 for supporting a spotter and has a longitudinally-extending member 245 which is supported on T-member 250. In the case of embodiment 200, the bench 212 is shown as being fixed in a generally horizontal position. In other respects, embodiment 200 is constructed and provides the same benefits to the user as the device shown in FIG. 1 but is generally intended for use in working the chest muscle group.

Figure 11:
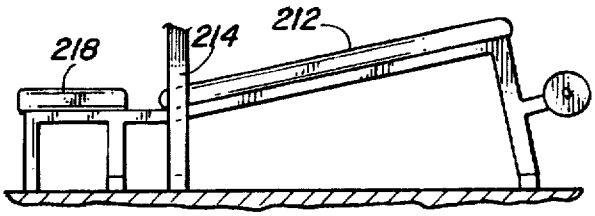
FIG. 11 is a side elevational view of the embodiment shown in FIG. 10.
Figure 10:
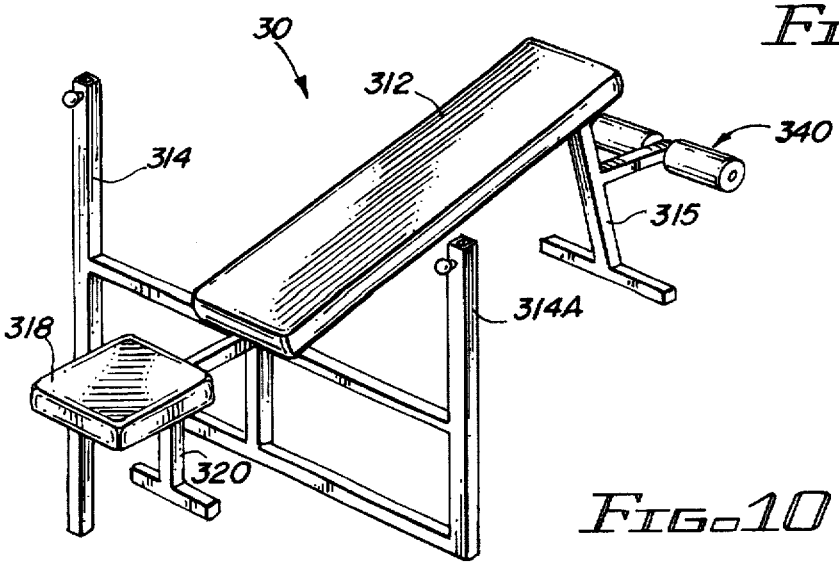
FIG. 10 is a perspective view of yet another embodiment of the present invention in which the bench is fixed in a generally inclined position.

The apparatus shown in FIGS. 10 to 11 is similar to that shown in FIGS. 8 and 9 and is designated by the numeral 300 and having a frame including vertically extending support members 314, 314A which telescopically receives weight-supports of the type previously described. Spotter platform 318 is supported on the vertical leg 320 located at the rear of the device. In this embodiment, the seat 314 is shown having a depending leg 315 which is shown as T-shaped and has laterally extending padded foot brace 340. The seat is padded and inclines forwardly so that the user's head, when in a supine position, is at a lower elevation than the feet. The incline makes exercises, such as sit-ups, more difficult.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

I claim:

1. An exercise apparatus for supporting both a weight lifter and dumbbells of the type having weights supported on the ends of an axially extending bar, said exercise apparatus comprising:

(a) a frame having a front and a rear and having spaced-apart, generally vertically extending supports defining an exercise area therebetween;

(b) a bench attached to said frame positioned within said exercise area, said bench having a forward end and a rear end and extending longitudinally on said frame; and (c) weight racks on said supports at a location laterally outward of the bench, said weight racks being disposed to support dumbbells thereon in a static position with the axis of the bars of the dumbbells being generally horizontal and extending toward said rear end defining an acute angle with respect to the axis of the bench to ergonomically accommodate removal and replacement of the dumbbells on the racks by a weight lifter said weight racks having one end attached, respectively, to said supports, and another end cantilevered into said exercise area from said supports so as to support the dumbbells substantially within said exercise area.

2. The exercise bench of claim 1 wherein said racks each consist of a pair of arcuate saddles disposed in spaced-apart relationship on a single frame member vertically adjustable with respect to said supports.

3. The exercise apparatus of claim 1 wherein said acute angle is approximately 10° to 20°.

4. An exercise apparatus for supporting a weight lifter and dumbbells of the type having weights supported on the ends of a bar, said exercise apparatus comprising:

(a) a frame defining an exercise area and having a longitudinally extending bench in said exercise area, said bench having a forward end and a rear end;

(b) a pair of dumbbell racks each having an inner and outer generally vertical arm member having upper and lower ends, the upper ends of the arm members each supporting a saddle configured to receive and support the weights of a dumbbell and defining an open space therebetween, the lower ends of said arm members being interconnected by a cross member which extends forwardly; and (c) vertical support members laterally attached to said frame located on opposite sides of said bench, said support members aligned with and supporting said dumbbell racks at opposite sides of said bench at a location generally aligned with the outer vertical arm member of each rack said cross members being cantilevered into said exercise area from said supports so as to support the dumbbells substantially within said exercise area, whereby a clearance area is provided below and between said saddles to accommodate the grasping, removal and replacing of dumbbells from below by a weight lifter.

5. The exercise apparatus of claim 4 further including a foot plate disposed adjacent one end of the bench.

6. The exercise apparatus of claim 4 further including a generally horizontal platform disposed between said supports at the head end of said bench.

7. The exercise apparatus of claim 6 wherein said platform includes adjustment means for vertically positioning said platform at a desired elevation.

8. The exercise apparatus of claim 4 wherein said bench has a back and a seat, said back and seat including means for adjusting one relative to the other.

9. The exercise apparatus of claim 4 wherein said racks each have a depending post which is adjustably receivable within the upper end of the associated support.

10. The exercise apparatus of claim 4 wherein said bench includes a carrier longitudinally adjustable on a track on said frame, said bench including a back with an adjustment plate pivotal on an axle at the upper end of said bench, further including a seat with an adjustment plate pivotally mounted on said axle, said adjustment plates each defining apertures therein and engageable with detent means selectively positionable in said apertures to adjust the relative position of said back and said seat.

11. The exercise apparatus of claim 10 wherein said seat and back are provided with cushioning material on the upper surface thereof.

12. The exercise apparatus of claim 4 wherein said cross member is generally curved.

13. The exercise apparatus of claim 4 wherein said saddles are angularly disposed with respect to the support members whereby the axis of the bars of the supported dumbbells intersect the longitudinal axis of the bench at a generally acute angle.

* * * * *